United States Patent [19]

Mattei et al.

[11] Patent Number: 4,736,703

[45] Date of Patent: Apr. 12, 1988

[54] DEVICE FOR APPLYING ADHESIVE MATERIAL TO SHEETS OF WRAPPING MATERIAL

[75] Inventors: Riccardo Mattei, Bologna; Marco Brizzi, Zola Predosa, both of Italy

[73] Assignee: G.D Società per Azioni, Bologna, Italy

[21] Appl. No.: 872,259

[22] Filed: Jun. 9, 1986

[30] Foreign Application Priority Data

Jun. 14, 1985 [IT] Italy ..... 3466 A/85

[51] Int. Cl.[4] ..... B05C 11/00

[52] U.S. Cl. ..... 118/663; 118/669; 118/50; 118/221; 118/225; 118/247; 118/704; 156/356; 156/358

[58] Field of Search ..... 118/245, 253, 675, 677, 118/681, 682, 238, 663, 669, 50, 221, 225, 247, 704; 156/358, 357, 356; 271/310, 311

[56] References Cited

U.S. PATENT DOCUMENTS

| | | | |
|---|---|---|---|
| 3,352,281 | 10/1967 | Scully | 118/245 |
| 4,167,994 | 9/1979 | Seragnoli | 198/457 |
| 4,526,360 | 7/1985 | Focke | 271/310 X |
| 4,559,758 | 12/1985 | Gamberini | 53/207 |

*Primary Examiner*—Jerome Massie
*Assistant Examiner*—Jeff Aftergut
*Attorney, Agent, or Firm*—Ladas & Parry

[57] ABSTRACT

A device for applying adhesive material to card blanks in a packeting machine, comprising a gumming roller and a pressing roller which are substantially mutually tangential and between which the blanks are led in succession to receive traces of adhesive material in predetermined zones. Should the packeting machine halt for a time exceeding a predetermined time limit, detachment means withdraw from the gumming roller that blank disposed between the two rollers in order to prevent it becoming stuck to the gumming roller.

8 Claims, 2 Drawing Sheets

DEVICE FOR APPLYING ADHESIVE MATERIAL TO SHEETS OF WRAPPING MATERIAL

This invention relates to a device for applying adhesive material to sheets of wrapping material.

In particular, the invention relates to a gumming device for applying adhesive material to card blanks in a packeting machine. Gumming devices of the aforesaid type are known comprising a pair of rollers, namely a gumming roller and a pressing roller, which rotate in opposing directions and are substantially mutually tangential along a common generator disposed along a rectilinear path followed by the blanks. The gumming roller is partially immersed in a container containing glue, and is provided with grooves in its cylindrical surface. Scraper means remove the excess glue from the gumming roller so that only a certain quantity of it remains within said grooves, and is then transferred by the roller to predetermined zones of the blanks.

A very serious difficulty arises in such devices at each prolonged stoppage of the packeting machine.

In this respect, during such stoppages, a blank remains in contact with the said pressing and gumming rollers, and if the machine is not restarted within a very short time this blank sticks to the gumming roller because the adhesive material present on it dries. On restarting the packeting machine, the blank itself separates from said rollers, but card fragments remain inevitably adhering to the gumming roller to block the grooves and prevent subsequent correct application of the glue by the device.

The object of the present invention is therefore to provide a gumming device which does not give rise to the described difficulty to the known art.

Said object is attained according to the present invention by a device for applying adhesive material to sheets of wrapping material, in particular to card blanks in a packeting machine, comprising a gumming element and a pressing element which rotate in opposing directions and are substantially tangential to each other, to define in correspondence with their zone of substantial tangency a passage for said blanks which are fed in succession, characterised by comprising a timer device for measuring the duration of each stoppage of said packeting machine, and means, controlled by said timer device, for detaching the blanks from said gumming element.

The present invention is described hereinafter with reference to the accompanying drawings, which illustrate a preferred embodiment thereof by way of non-limiting example, and in which.

Figure 1:
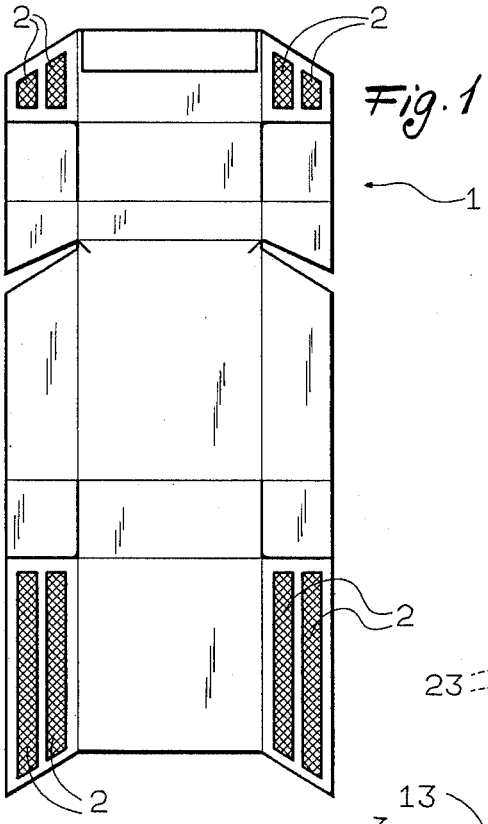
FIG. 1 shows a card blank arranged to receive adhesive material in predetermined zones from a device constructed in accordance with the present invention.

In FIG. 1, the reference numeral 1 indicates a card blank for wrapping a product. In the case considered by way of example in the description given hereinafter, said product is a group of cigarettes (not shown) to be enclosed by a blank to form a rigid packet of cigarettes.

Figure 3:
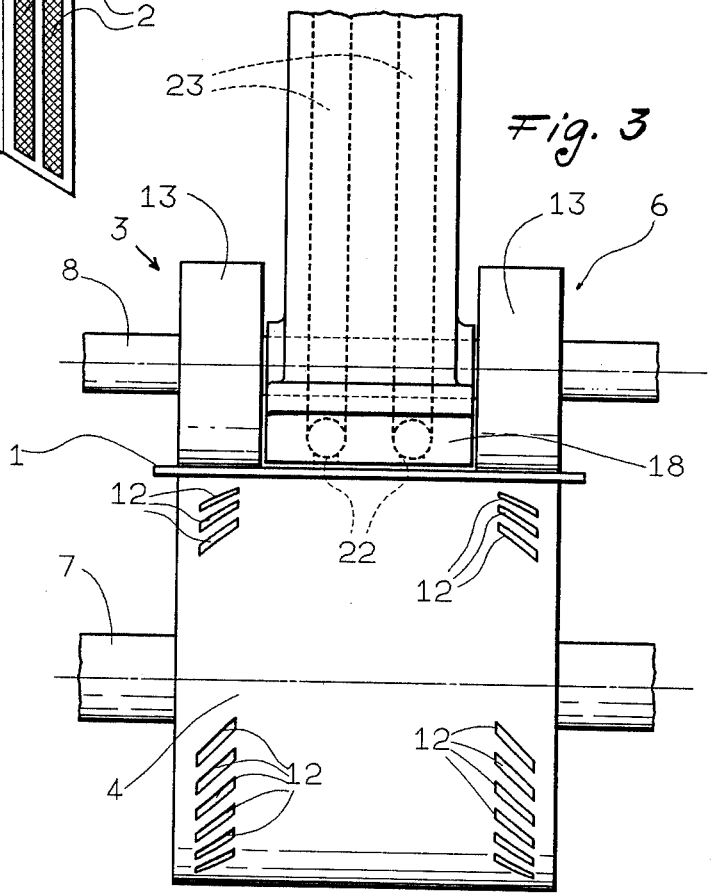
FIG. 3 is a further diagrammatic partial side view of the device of FIG. 2.
Figure 2:
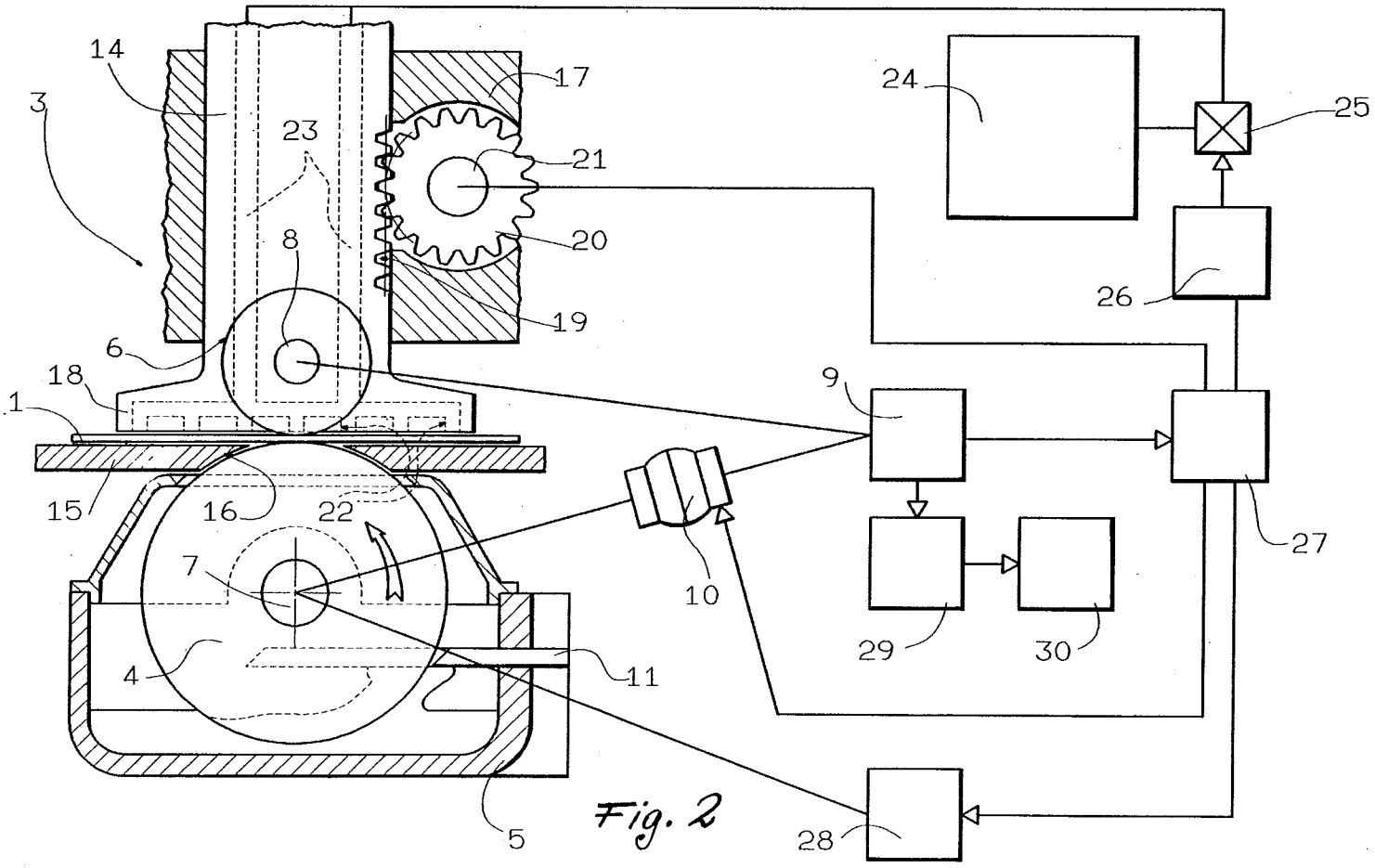
FIG. 2 is a diagrammatic side view, partly in block diagram form, of a device constructed in accordance with the present invention.

The reference numeral 2 indicates the parallel traces of glue applied to determined zones of the blank 1 by a gumming device indicated overall by 3 and shown in FIGS. 2 and 3.

The gumming device 3 comprises a gumming element in the form of a gumming roller 4 partially immersed in a vessel 5 containing adhesive material, and a pressing element in the form of a pressing roller 6 superposed on the roller 4 and substantially tangential to it.

The rollers 4 and 6 are supported and rotated with intermittent rotary motion respectively in an anti-clockwise and clockwise direction by respective shafts 7 and 8 connected in a manner not shown to a motor 9 of the packeting machine (not shown) in which the gumming device 3 is installed. For reasons which will be apparent hereinafter, the connection between the shaft 7 and motor 9 is made by a phase recovery coupling 10 of known type (of the type described for example in British patent application No. 2,132,304). This type of coupling enables the connection between the shaft 7 and said motor 9 to be interrupted, and said elements to be then reconnected at any moment such that the shaft 7 rotates with the same phase relationship to the other moving parts of the packeting machine as existed before such interruption.

The periphery and sides of the gumming roller 4 are grazed below the shaft 7 by a scraper element 11 able to remove the excess adhesive material from the periphery of the rotating roller 4, to leave only a certain quantity of it in grooves 12 provided in the roller 4 (see FIG. 3).

The pressing roller 6 is composed of a first and a second roller 13 keyed on the shaft 8, at the two opposite sides of a support element 14 lying above the roller 4. The rollers 13 have their peripheral surfaces facing those portions of the roller 4 provided with said grooves 12, to define in combination with said roller 4 a passage for the blanks 1 fed in succession to the gumming device 3 by feed means, not shown. This passage is also defined lowerly by a horizontal bench 15 provided with an interruption 16 in correspondence with the zone of tangency between the rollers 4 and 6 and above and along which bench the blanks 1 are successively advanced by conventional means, not shown.

The support element 14 is supported in a vertical slidable manner by a packeting machine frame 17, and lowerly comprises a detachment means in the form of a horizontal shoe 18 disposed between the two rollers 13 with its lower surface slightly raised from the upper surface of the bench 15. The support element is provided laterally with a rack 19 which is engaged by a pinion 20 supported on the packeting machine base 17 by a shaft 21 parallel to the shafts 7 and 8. The pinion 20 and rack 19 form a means for moving the support element 14 and its connected shoe 18. The lower surface of the shoe 18 comprises a number of apertures 22 connected by ducts 23 through the support element 14 to a vacuum pump 24. Between the apertures 22 and vacuum pump 24 there is disposed a valve 25 controlled by an actuator 26 which is operated by a timer device 27 in the manner described hereinafter.

The timer device 27 is also able to control the operation of a motor 28 which rotates the gumming roller 4 during stoppage of the motor 9.

A machine-cycle counting device 29 is connected to the motor 9, and as will be apparent hereinafter is able to operate an expulsion device 30 for blanks 1, or for packets (not shown) formed from said blanks 1.

When in operation, the blanks 1 reach the gumming device 3 in succession, and pass between the rollers 4 and 6 to receive glue traces 2 from the grooves 12 of the roller 4.

During normal operation of the packeting machine and gumming device 3, the support element 14 is maintained, by virtue of the engagement between the pinion 20 and rack 19, in its lower end-of-travel position with the shoe 18 disposed in such a position as to skim the upper surface of the blanks 1 moving along the bench 15.

Should the packeting machine halt, the rollers 4 and 6 cease to rotate and the timer device 27 is activated by the stoppage of the motor 9.

If the packeting machine is restarted within a predetermiined time limit, the rollers 4 and 6 resume rotation without the aforesaid difficulties occurring.

If however the packeting machine stoppage lasts for longer than said predetermined time limit, the timer device 27 disengages the coupling 10, with consequent disengagement of the roller 4 from the motor 9.

The timer device 27 then operates the actuator 26, which opens the valve 25 to connect the pump 24 to the apertures 22. The blank 1 present between the rollers 4 and 6 is thus attracted by the shoe 18, and adheres to its lower surface to become slightly separated from the bench 15. Simultaneously, by way of actuator means of known type, not shown, the timer device 27 causes the pinion 20 to rotate clockwise (for an observer of FIG. 2), to raise the support element 14 by means of the rack 19, thus withdrawing the shoe 18 from the bench 15 and the roller 6 from the roller 4.

The timer device 27 also activates the motor 28, which again rotates the gumming roller 4 during the entire stoppage time of the packeting machine in order to prevent drying of the glue in the grooves 12.

When the motor 9 and packeting machine restart, the timer device 27 is deactivated, with consequent stoppage of the motor 28, engagement of the coupling 10, closure of the valve 25 and anticlockwise rotation of the pinion 20 to cause the support element 14, shoe 18 and roller 6 to descend. The suction is thus interrupted and the blank dropped onto the advancing means.

The motor 9 also activates the machine-cycle counting device 29, which after a predetermined number of machine cycles sufficient for that blank 1 which on stoppage of the packeting machine was between the rollers 4 and 6 or the packet (not shown) obtained from it to reach the expulsion device 30, activates said expulsion device 30 to expel said blank or packet. In other words, the expulsion device expels the faulty blank or packet which was between the gumming roller and pressing roller during the stoppage. The counting device counts machine cycles after restart of the operation so as to determine when the faulty packet, which was between the gumming roller and pressing roller during stoppage, will have reached the expulsion device. In a non-illustrated modification of the gumming device 3 according to the invention, the shoe 18 can be separate from the support element 14 and be mounted between the rollers 13 in a fixed position a short distance form the bench 15. In this case, if prolonged stoppages of the packeting machine occur, that blank 1 which is above the roller 4 is separated therefrom only by the suction effect through the apertures 22.

From the aforegoing it is apparent that with the described gumming device 3 the described difficulties of known gumming devices do not arise, even in the case of prolonged stoppages of the packeting material in which the device of the invention is mounted. This is because by withdrawing that blank 1 being gummed by the gumming roller 4 when the packeting machine undergoes prolonged stoppage, the blank 1 is prevented from remaining stuck to the roller 4 and thus giving rise to the typical difficulties of gumming devices of known type.

We claim:

1. A device for applying adhesive material to sheets of wrapping material in a packaging machine, the device comprising: a frame; a gumming roller; a first motor for driving the gumming roller; a support element disposed above the gumming roller; a pressing roller carried by the support element and driven by the first motor in a direction opposite to that of the gumming roller, the pressing roller and gumming roller being substantially tangential to each other; a horizontal bench between the gumming roller and pressing roller, the bench having an interruption corresponding to the tangential portions of the rollers; advancing means for advancing successive card blanks along the horizontal bench; suction means on the support element, the suction means being located over the gumming roller; and timer means for measuring the duration of a stoppage of the device, the timer means activating the suction means and deactivating the first motor a predetermined period after each stoppage, the timer further deactivating the suction means and activating the first motor at the end of the stoppage.

2. A device as claimed in claim 1 further comprising machine counting means associated with the first motor, and an expulsion device operated by the machine counting means, the expulsion device expelling that blank present, during the stoppage, between the gumming roller and pressing roller.

3. A device according to claim 1 further comprising means associated with the support element and controlled by the timer means for moving the suction means away from the horizontal bench when the stoppage exceeds a predetermined time limit, said means moving the suction means towards the horizontal bench at the end of the stoppage.

4. A device as claimed in claim 3 wherein the means associated with the support element comprises a pinion keyed on a shaft supported by the frame, and a rack on the support element.

5. A device as claimed in claim 1 wherein the pressing roller comprises a first and a second roller keyed on a common driving shaft and disposed on the opposite sides of the support elements.

6. A device as claimed in claim 5 wherein the suction means comprises a shoe having apertures therein, a vacuum pump connected to the shoe, the shoe being disposed in the support element between the first and second rollers and facing the horizontal bench.

7. A device as claimed in claim 1 wherein the gumming roller is driven by the first motor by interposition of a phase recovering coupling.

8. A device as claimed in claim 1 further comprising a second motor associated with the gumming roller and controlled by the timer means, the second motor rotating the gumming roller during stoppage of the device.

* * * * *